United States Patent [19]

Monn

[11] 4,008,694

[45] Feb. 22, 1977

[54] ROTARY CYCLING VALVE FOR INTERNAL COMBUSTION ENGINES

[76] Inventor: Walter Monn, Via Codeborgo 16, 6500 Bellinzona, Switzerland

[22] Filed: Jan. 22, 1975

[21] Appl. No.: 543,141

[30] Foreign Application Priority Data

Jan. 30, 1974 Switzerland ..... 1231/74
Nov. 14, 1974 Germany ..... 2454006

[52] U.S. Cl. ..... 123/41.4; 123/190 E
[51] Int. Cl.² ..... F01P 1/08
[58] Field of Search ..... 123/41.4, 190 E

[56] References Cited

UNITED STATES PATENTS

| | | | |
|---|---|---|---|
| 1,413,567 | 4/1922 | Bennett | 123/41.4 |
| 1,519,513 | 12/1924 | Smith | 123/41.4 |
| 1,860,725 | 5/1932 | Stoner | 123/41.4 |
| 2,056,684 | 10/1936 | McLaren | 123/41.4 |
| 2,181,868 | 12/1939 | Cantoni | 123/190 E |
| 2,617,395 | 11/1952 | Haase | 123/190 E |
| 2,714,882 | 8/1955 | Brevard | 123/190 E |
| 2,853,980 | 9/1958 | Zimmerman | 123/41.4 |

*Primary Examiner*—Wendell E. Burns
*Assistant Examiner*—David D. Reynolds
*Attorney, Agent, or Firm*—James E. Nilles

[57] ABSTRACT

A cycling valve for an internal combustion engine comprises a valve housing on top of the engine block and a circular rotary valve body within the housing geared to the crank shaft of the engine. Air of sub-atmospheric pressure developed in the engine crankcase is drawn through a system of cooling passages in the valve body and through an additional system of cooling passages in the base of the valve housing.

20 Claims, 4 Drawing Figures

I
I
83
81
13
7
79
21
59
43
57
77
11
85
55
53
69
75
31
29
27
25
23
3
1
51
67
73
39
47
45
41
71
9
85
83
81
37
15
79
19
17

II
II
39
18
15
65
37
67
44
33, 35
45
47
49
53
31
29
27
71
23
35
33
3
1
7
37
9
63
51
87
89
61
39
41
25
73

ROTARY CYCLING VALVE FOR INTERNAL COMBUSTION ENGINES

BACKGROUND

The present invention relates to the cycling of an internal combustion engine by means of a circular rotary valve body which is enclosed within a housing and provided with passages for connecting at least one engine cylinder with one or more suction channels and with one or more exhaust channels.

SUMMARY OF THE INVENTION

The invention provides an improved cycling system for internal combustion engines, particularly for four cycle engines. The improved system is relatively simple; it lessens fuel consumption; and it also lessens contamination of the environment by reducing the CO content of the exhaust gases.

In an internal combustion engine incorporating the invention a valve housing and a rotary circular valve body therein are provided with a system of cooling ducts which is connected with an engine related source of subatmospheric pressure. The cooling system incorporates cooling chambers within the valve body and cooling medium circulating passages which lead from radially inner to radially outer portions of the circular valve body.

DRAWINGS

In the following, a preferred embodiment of the invention will be described in detail with reference to the accompanying drawings wherein.

Figure 2:
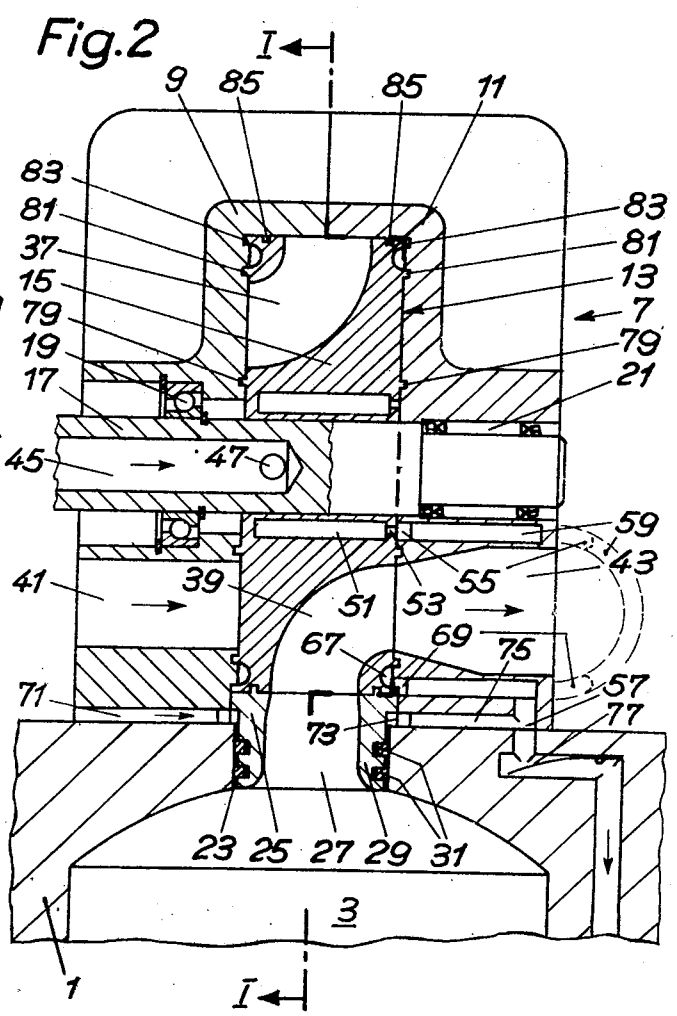
FIG. 2 shows a rotary cycling valve analogous to FIG. 1 in section on line II—II of FIG. 1.
Figure 1:
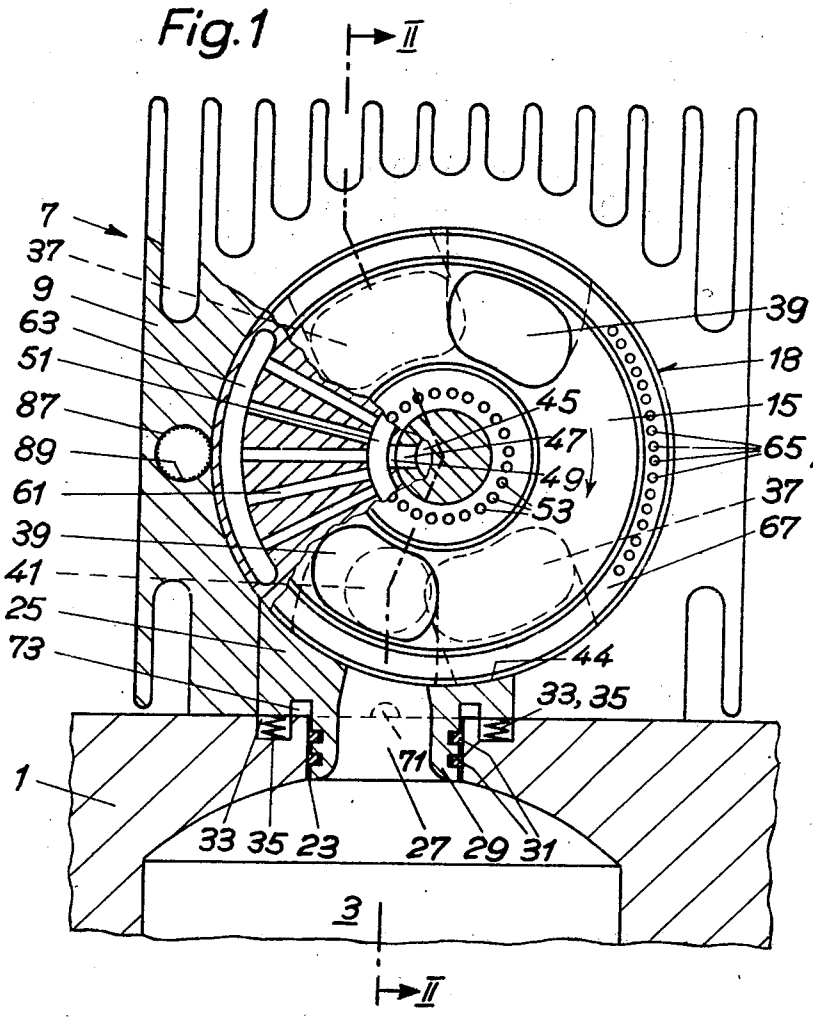
FIG. 1 is a sectional view of a rotary cycling valve for a four cycle internal combustion engine, the view being taken on line I-I of FIG. 2 with portions broken away.

FIGS. 1 and 2 show part of a cylinder head 1 of a four cycle internal combustion engine having a combustion- or cylinder space 3. Mounted on top of the engine block or cylinder head 1, as by bolting, is a cycling unit 7. The unit 7 comprises two housing halves 9 and 11 which are secured together, as by bolting. Positioned between the housing halves 9 and 11 is a circular rotary valve body consisting of a rotor 15 and a shaft 17. The shaft 17 extends at one end into a radial and axial load transmitting bearing 19 of the housing half 9, and at the other end into a radial load transmitting bearing 21 of the housing half 11.

The cylinder head 1 has a bore 23 which extends from the combustion chamber 3 into the housing 9, 11 and which is offset in the direction of rotation of the valve body 15 from the axis of the shaft 17. Fitted into the bore 23 is a spring cushioned connecting shoe 25 presenting a passage 27. A cylindrical stud 29 which forms part of the shoe 25 is provided with sealing rings 31 in the manner of piston sealing rings. The cylinder head is provided with recesses 33 spaced radially from the bore 23, for the reception of coil springs 35. The connecting shoe 25 is sustained by the springs 35 and yieldingly urged thereby against the rotor 15.

The rotor 15 is provided with a total of four passages 37, 39 at 90° spacings from each other, these passages extending in 90° elbow fashion between the peripheral surface 18 of the rotor 15 and its axially opposite side faces, respectively. A pair of diametrically opposite suction passages 37 connect a suction port 41 of the housing half with the passage 27 of the connecting shoe 25. The rotor 25 further has two diametrically opposite exhaust passages 39 which are displaced 45° relative to the suction passages 37 and which connect the passage 27 with an exhaust nozzle 43 of the housing half 11. The cross sections of the passages 37 and 39 are of substantially rectangular shape on the peripheral surface of the rotor 15 whereas the corresponding cross sections on the side faces of the rotor 15 are generally kidney shaped. The suction port 41 and the exhaust nozzle 43 have a circular cross section. The mentioned connections by means of the passages 37 between the suction port 41 and the passage 27, on one hand, and the connections by means of the passages 39 between the passage 27 and the exhaust nozzle 43 on the other hand, are established only in corresponding positions of the rotor 15. FIG. 2 illustrates the exhaust position of the rotor 15. In all other positions the connecting shoe 25 with its contact surface 44 provides the necessary outward sealing of the cylinder space 3.

Provisions for cooling the rotor 15, the exhaust nozzle 43 and the connecting shoe 25 are made as follows:

The shaft 17 is provided with a central axially extending bore 45 at the end of which two radial passages 47 extend outward from the bore 45. These passages 47 of the shaft 17 are continued by two channels 49 within the rotor 15 and terminate in an interior annular space 51. A series of bores 53 which are uniformly distributed around the rotor 15 lead from the annular space 51 via an internal segmental annular slot 55 of the housing half 11 in the vicinity of the exhaust nozzle 43 into an annular space 59 which extends concentrically around the exhaust nozzle 43.

Radial air channels 61 further extend outward from the inner annular space 51 into two radially opposite outer annularly segmental spaces 63, only one of which is shown in FIG. 1. Advantageously, the air channels 61 may be bent forwardly. Two groups of bores 65 are associated, respectively, with the segmental spaces 63 and extend therefrom into an annular groove 67 in the side face 13 of the rotor 15 opposite to the housing half 11. The annular groove also communicates with the annular space 59 in the vicinity of the exhaust nozzle 43 via an outer annularly segmental groove 69 of the housing half 11.

A channel 71 in the base of the housing half 9 terminates in an annular groove 73 which surrounds the cylindrical stud 29 of the connecting shoe 25. Diametrically opposite to the channel 71 a further channel 75 in the base of the housing half 11 leaves the annular groove 73 in order to join at 57 the above described cooling system or rather the annular space 59 via a connecting bore. These two cooling systems communicate via a check valve 77 with the crankcase of the internal combustion engine.

Rings 79, 81, 83 and 85 at the side faces and the circumferential face of the rotor 15 project into corresponding grooves of the two housing halves and provide labyrinth seals.

The rotor 15, incidentally, does not touch either of the surrounding housing halves 9 and 11.

A bore 87 (FIG. 1) within the housing 9, 11 serves to receive an oil sieve 89 in the form of a lubricating wick. The bore 87 tangentially intersects the housing space for the rotor 15 in such a manner that the oil sieve 89 which receives oil from the lubricating network of the engine delivers it on a narrow peripheral surface to the circumference 18 of the rotor. Since the resiliently supported connecting shoe 25 consists, at least within the range of its contact surface 44, of self-greasing metal, for instance self-greasing bronze, the frictional resistance here is also reduced to a minimum at optimal sealing.

The above described cycling system incorporating a housed rotary valve body for cycling a four cycle internal combustion engine, is coupled to the engine in such a manner that the rotor 15 turns one-half revolution per cycle, that is, during two revolutions of the crankshaft in accordance with the two suction passages 37 and exhaust passage 39. Consequently, the reduction ratio is 4:1.

The above described rotary circular valve body operates in conjunction with a four cycle internal combustion engine as follows:

In the condition illustrated by FIGS. 1 and 2, the engine piston (not shown) is on the exhaust stroke which expells the spent combustion gases from the cylinder space, that is, from the combustion or cylinder space 3. This expulsion takes place through the passage 27 and through the exhaust passage 39 into the exhaust nozzle 43 from which the exhaust gases pass into the atmosphere.

During the subsequent suction stroke the engine piston descends from its upper dead center position within the cylinder space 3. The rotor 15 has continued to rotate in the direction of the arrow shown in FIG. 1 whereby the suction passage 37 within the rotor progressively uncovers a gradually increasing opening to the passage 27 and to the suction port 41. Due to the development of a subatmospheric pressure in the combustion chamber 3 by operation of the engine piston external air is drawn through the suction port 41 into the suction passage 37 and from the latter through the passage 27 into the combustion space, that is, the cylinder space 3. This action continues until the trailing edge of the suction passage 37 overlaps the forward edge of the suction port 41 or that of the passage 27 with the result that the cylinder space 3 is sealed outward whereupon the filling of the cylinder space 3 is completed.

During the subsequent compression stroke the engine piston pressurizes the sucked in combustion air within the cylinder space 3 and at the proper moment a benzene injection into this air is effected so that an explosive mixture is formed.

It is also possible, of course, to place a carburetor ahead of the suction port 41 so that a mixture of benzene vapor and air rather than air only is admitted to the combustion space 3 through the described passages.

Shortly before the piston reaches its upper dead center position this mixture is ignited by a sparkplug and the pressure of the resulting explosion forces the piston down while transferring energy to the crankshaft. During this time the rotor 15 must seal the combustion space 3 as tightly as possible so that the combustion gases under their high pressure are not uselessly dissipated outward past the cylinder head and the cycling unit 7. For that reason, the connecting shoe 25 is arranged resiliently within the cylinder head 1 so that it has the possibility under the pressure within the combustion space 3 and the additional pressure of the coil springs 35 to bear with its sealing surface 44 firmly upon the rotor 15. At the same time, the selflubricating metal of which the connecting shoe 25 is made at least within the range of the sealing surface 44 functions to keep the friction and therefore the wear and energy loss as small as possible. The outward seal is effected by the seal rings 31.

At the end of the power stroke when the piston occupies its lower dead center position the rotor 15 has continued to turn so that during the subsequent exhaust stroke which has been described above, the connection of the combustion space 3 with the exhaust passage 39 and the exhaust nozzle 43 is re-established via the passage 27.

It is evident that the explained cycling unit 7 is subjected to very high thermal strains which is particularly true for the rotor 15 within the housing halves 9, 11 with its shaft 17; for the connecting shoe 25; and for the exhaust nozzle 43. These parts must therefore be cooled particularly well, intensely and reliably in such a manner that as nearly as possible no temperature peaks are incurred. For that purpose cooling air is also passed, by reason of the subatmospheric pressure in the crankcase and the centrifugal force on the rotor, through the central axial bore 45 of the shaft 17, its passages 47 and the passages 49 into the interior annular space 51 of the rotor 15.

The cooling air leaves the annular space 51 through the bores 53 when they merge with the annularly segmental slot 55 from which the cooling air flows into the annular space 59. A portion of the cooling air which has entered the annular space 51 through the channels 49 flows, assisted by the centrifugal force of the turning rotor 15, through the air channels 61 into the annularly segmental spaces 63. The cooling air leaves these segmental spaces 63 through the bores 65 (FIG. 1). It flows into the annular groove 67 and passes via the annularly segmental slot 69 into the annular space 59.

Additional cooling air which is sucked into the channel 71 will flow through the annular groove 73. At the opposite side the cooling air flows into the channel 75. The above described streams of cooling air merge at 57 and flow jointly, after passing through the check valve 77, into the crankcase which is the actual suction source for the cooling air.

The check valve 77 functions to prevent the back flow of hot gases from the crankcase into the cooling system at each down-stroke of the piston.

The openings 65 terminate in the annular space 67 which permanently communicates with the annularly segmantal slot 69. Consequently, whenever a pressure differential exists between the bore 45 and the crankcase cooling air flows through the cooling system. This pressure differential is pronounced during the compression phase and the exhaust phase.

The peripheral surface 18 of the rotor is lubricated by the lubricating wick afforded by the sieve 89, and a sealing coat of soot is formed by the exhaust gases on the inner wall of the housing half 11 and the adjacent side face 13 of the rotor whereby the sealing of the whole system is further improved in a natural manner.

During the expulsion or outflow of the combustion gases the direction change (impulse difference vector) during the transfer from the passage 27 into the exhaust nozzle 43 produces a force on the rotor which due to the offset of the exhaust passage 39 from the axis of the rotor exerts an additional driving torque upon the latter which has a beneficial effect upon the ratio between power output and fuel consumption.

Extensive tests have shown that with respect to a rotary circular valve body such as described above, and a connecting shoe which is slideable against the valve body and has a passage connecting the cylinder space with the valve body, the connecting shoe is of critical importance.

In order to provide for the lubrication of the bearing surface of a rotary valve body for internal combustion engines, it has heretofore been known to seal the connecting shoe by means of a ring which under the very variable gas pressure urges the connecting shoe against the rotor. This is unsatisfactory because the sealing pressure varies considerably. Even though the moving masses of the connecting shoe and of the ring are unable to follow the pressure fluctuations which have a high frequency corresponding to the number of revolutions per minute, the rotor is nevertheless subjected to an uneven retarding force which is difficult to control. In the prior art device, the pressure gases are further apt to escape between the connecting shoe and the sealing ring. It is further absolutely necessary to finish the sealing ring at its sealing face as well as laterally with a high degree of accuracy if the seal is to be reasonably efficient. A cone shaped sealing surface such as is provided by the prior art moreover entails sealing difficulties more readily than a cylindrical one. These disadvantages are avoided by the seal structure described hereinbelow.

Figure 3:
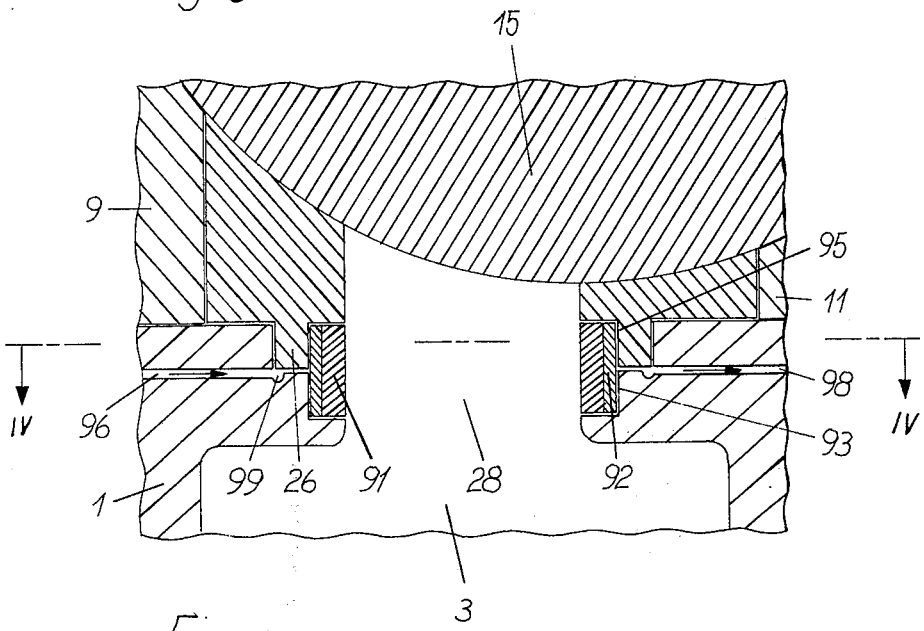
FIG. 3 shows a portion of a section through a rotary cycling valve for a four cycle internal combustion engine, taken on line III—III of FIG. 4.
Figure 4:
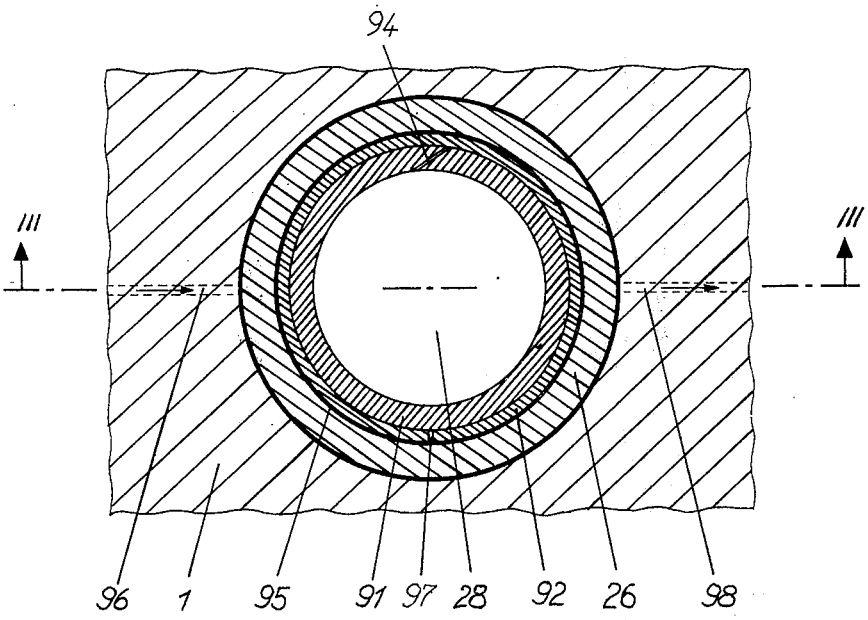
FIG. 4 shows a portion of a rotary cycling valve analogous to FIG. 3 in section on line IV—IV of FIG. 3.

The general arrangement of an improved rotary cycling valve for an internal combustion engine is shown in FIGS. 1 and 2. Analogously, the cylinder head 1 with the combustion space 3 and the rotor 15 are seen in FIGS. 3 and 4. Also provided is a connecting shoe 26 with a central passage 28. As a modification of the seal structure described with reference to FIGS. 1 and 2, the seal structure shown in FIGS. 3 and 4 incorporates two concentric, relatively nested sealing rings 91 and 92 which are supported, on one hand, in a cylindrical recess 93 of the cylinder head 1 and, on the other hand, in a cylindrical recess 95 of the connecting shoe 26 for the rotary valve body. It would be possible, of course, to use only one sealing ring. As may be seen in FIG. 4, the inner sealing ring 91 is provided with an oblique gap 94, and the outer sealing ring 92 is provided with a radial gap 97. This makes it possible for the two rings during the expulsion of the hot combustion gases to sealingly bear against the corresponding walls of the recesses 93 and 95 and to suppress leakage along the connecting shoe 26. For the purpose of cooling the thermally highly strained sealing rings 91 and 92, an oil admitting channel 96 leads into an annular cooling space 99 from which the cooling oil is drained through a discharge passage 98.

The connecting shoe 26 must shift axially in order to continuously bear against the rotor 15, and its necessary sliding takes place on the outer peripheral surface of the sealing ring 92. In the illustrated embodiment, this peripheral surface is cylindrical. In principle, it would also be possible to provide a stepped exterior peripheral surface of the ring 92 and to dimensions the outer diameters of the recesses 93 and 95 differently in conformity with the stepped peripheral surface of the ring 92. The sealing rings 91 and 92 are preferably secured against rotation about their polar axes. The configuration of the connecting shoe 26 is such that the pressure of the gases, particularly at the moment of explosion, does not act axially upon the connecting shoe. However, it is possible to urge the shoe with a suitably proportioned initial force against the rotor 15 by means of springs as previously mentioned in order to keep the seepage losses there as low as possible.

Having in mind the large temperature differences which follow each other in rapid succession, it is desirable to keep the mass of the connecting shoe as small as possible. As a consequence, the biasing force upon the connecting shoe and the braking effect upon the rotating valve body, will be small. The connecting shoe will thus serve as a connecting element between the cylinder head and the valve housing and also, as nearly as possible, as a sealing organ.

In this connection, it is advantageous if at least one ring has a radial or oblique gap whereby at high pressures, particularly of the combustion gases, these rings may be forced against the outer wall and insure proper sealing.

It is further advantageous if the sealing ring is supported in the connecting shoe as well as in the cylinder head in order to improve the seal and provide a connection between the cylinder head and the housing of the rotary valve body which, for all practical purposes, is completely gas pressure tight.

In order to reduce the thermal strain on the sealing ring which is exposed directly to the combustion gases, provisions are made for cooling it, preferably by pressure oil.

I claim:

1. A rotary cycling valve for internal combustion engines, comprising a valve housing having suction and exhaust ports; a circular rotary valve body within said housing having internal passages adapted to selectively connect said suction and exhaust ports with the working space of an engine cylinder; and a cooling system operatively associated with said housing and valve body and connected with an engine related source of subatmospheric pressure; said cooling system comprising cooling chambers within said valve body and cooling medium circulating channels leading from radially inner to radially outer portions of said valve body, said internal passages of said valve body providing inlet and outlet openings, respectively, on its periphery and outlet and inlet openings, respectively on one and the other of its side faces, and wherein a drive shaft of said valve body has an axial cooling air conducting bore in communication with radial cooling air admitting bores thereof.

2. A rotary cycling valve as set forth by claim 1 wherein said cooling medium circulating channels extend radially between annularly segmental cooling chambers of said valve body.

3. A rotary cycling valve for internal combustion engines, comprising a valve housing having suction and exhaust ports; a circular rotary valve body within said housing having internal passages adapted to selectively connect said suction and exhaust ports with the working space of an engine cylinder; and a cooling system operatively associated with said housing and valve body and connected with an engine related source of subatmospheric pressure; said cooling system comprising cooling chambers within said valve body and cooling medium circulating channels leading from radially inner to radially outer portions of said valve body, said cooling medium circulating channels extending radially between angularly segmental cooling chambers of said valve body, and at least one of said annularly segmental chambers being provided with holes terminating at one side face of said valve body.

4. A rotary cycling valve as set forth by claim 3 wherein said holes are arranged in groups corresponding in number to the number of the associated annularly segmental chambers.

5. A rotary cycling valve as set forth by claim 4 wherein said cooling system is connected with a source of subatmospheric pressure afforded by the crankcase of the internal combustion engine.

6. A rotary cycling valve as set forth by claim 5 wherein a check valve is arranged downstream from the valve body so as to prevent return flow of hot air from the engine crankcase into said cooling system.

7. A rotary cycling valve as set forth by claim 1 wherein said valve body is substantially devoid of contact with said valve housing.

8. A rotary cycling valve as set forth by claim 1 and further comprising circumferential labyrinth seal means between said valve body and said valve housing.

9. A rotary cycling valve as set forth by claim 1, wherein said valve body is provided with a plurality of air admitting suction passages and with a plurality of combustion gases emitting exhaust passages.

10. A rotary cycling valve for internal combustion engines, comprising a valve housing having suction and exhaust ports; a circular rotary valve body within said housing having internal passages adapted to selectively connect said suction and exhaust ports with the working space of an engine cylinder; and a cooling system operatively associated with said housing and valve body and connected with an engine related source of subatmospheric pressure; said cooling system comprising cooling chambers within said valve body and cooling medium circulating channels leading from radially inner to radially outer portions of said valve body, the outlet side of said valve body being provided at its periphery with an annular groove in permanent communication with the discharge side of said housing so as to cool the outlet end of said exhaust passage.

11. A rotary cycling valve for internal combustion engines, comprising a valve housing having suction and exhaust ports; a circular rotary valve body within said housing having internal passages adapted to selectively connect said suction and exhaust ports with the working space of an engine cylinder; and a cooling system operatively associated with said housing and valve body and connected with an engine related source of subatmospheric pressure; said cooling system comprising cooling chambers within said valve body and cooling medium circulating channels leading from radially inner to radially outer portions of said valve body, said exhaust port of said valve housing being surrounded by an annular space and wherein cooling air admitting slots terminate in said annular space.

12. A rotary cycling valve for internal combustion engines, comprising a valve housing having suction and exhaust ports; a circular rotary valve body within said housing having internal passages adapted to selectively connect said suction and exhaust ports with the working space of an engine cylinder; and a cooling system operatively associated with said housing and valve body and connected with an engine related source of subatmospheric pressure; said cooling system comprising cooling chambers within said valve body and cooling medium circulating channels leading from radially inner to radially outer portions of said valve body, and cooling channels for air and oil supply arranged around a sealing shoe in cooperative engagement with said valve body, said cooling air supply channel being connected to an engine related source of subatmospheric pressure.

13. A rotary cycling valve as set forth by claim 1, wherein a connecting passage between the valve housing and the engine cylinder is offset from the axis of said valve body drive shaft so that combustion gases flowing through said offset passage will exert a turning torque upon said valve body.

14. A rotary cycling valve for internal combustion engines, comprising: a valve housing having suction and exhaust ports; a circular rotary valve body within said housing having internal passages adapted to selectively connect said suction and exhaust ports with the working space of an engine cylinder; and a cooling system operatively associated with said housing and valve body and connected with an engine related source of sub-atmospheric pressure; said cooling system comprising cooling chambers within said valve body and cooling medium circulating channels leading from radially inner to radially outer portions of said valve body, a connecting shoe between said cylinder head and said valve body, said shoe being shiftable against said valve body and provided with a passage inter-connecting said working space of said engine cylinder with said valve body, said connecting shoe being provided with a groove enclosing at least a part of one sealing ring, and cooling channels for air and oil supply arranged around a sealing shoe in cooperative engagement with said valve body, said cooling air supply channel being connected to an engine related source of sub-atmospheric pressure.

15. A rotary cycling valve as set forth in claim 14, comprising a pair of concentric relatively nested sealing rings within said groove.

16. A rotary cycling valve as set forth by claim 14 wherein said sealing ring is provided with a peripheral gap.

17. A rotary cycling valve as set forth by claim 14 wherein said external groove of said connecting shoe is peripherally cylindrical.

18. A rotary cycling valve as set forth in claim 14 wherein said sealing ring is embraced by said connecting shoe as well as by said cylinder head.

19. The valve set forth in claim 14 further characterized in that said groove is externally located on said shoe.

20. The valve set forth in claim 14 further characterized in that said groove is located internally on said shoe.

* * * * *